US005615416A

United States Patent [19]

Haddad

[11] Patent Number: 5,615,416

[45] Date of Patent: Apr. 1, 1997

[54] ADJUSTMENT STRAP FOR JACKET HOOD

[75] Inventor: Jack C. Haddad, Brooklyn, N.Y.

[73] Assignee: The Haddad Apparel Group, Ltd., New York, N.Y.

[21] Appl. No.: 538,418

[22] Filed: Oct. 2, 1995

[51] Int. Cl.[6] ..... A42B 1/04

[52] U.S. Cl. ..... 2/202; 2/171; 2/84

[58] Field of Search ..... 2/84, 85, 202, 2/203, 204, 205, 171; 24/68 R, 68 E, 68 F, 72, 212.1, 712.4, 713

[56] References Cited

U.S. PATENT DOCUMENTS

| | | | |
|---|---|---|---|
| 644,379 | 2/1900 | Vendig . | |
| 768,626 | 8/1904 | Rautenberg . | |
| 2,136,380 | 11/1938 | Garrison | 2/84 |
| 2,272,959 | 7/1940 | Van Wormer . | |
| 2,299,432 | 8/1940 | Skreberg . | |
| 2,368,654 | 2/1945 | Frank | 2/84 |
| 2,581,366 | 1/1952 | De Grazia . | |
| 2,685,091 | 8/1954 | Thill . | |
| 3,676,879 | 7/1972 | Irie . | |
| 3,696,474 | 10/1972 | Slauta . | |
| 3,698,014 | 10/1972 | Little et al. . | |
| 3,731,320 | 5/1973 | White et al. . | |
| 4,411,023 | 10/1983 | Pinson . | |
| 5,007,115 | 4/1991 | Denbow et al. . | |
| 5,339,466 | 8/1994 | McMullen . | |

FOREIGN PATENT DOCUMENTS

| | | |
|---|---|---|
| 568000 | 6/1911 | France . |
| 836571 | 4/1952 | Germany . |
| 92942 | 11/1959 | Netherlands . |
| 94689 | 2/1958 | Norway . |
| 175594 | 6/1961 | Sweden . |
| 571 | 5/1911 | United Kingdom . |
| 548815 | 10/1942 | United Kingdom . |
| WO93/13682 | 7/1993 | WIPO . |

OTHER PUBLICATIONS

"Madoga coat"Sep. 5, 1995.

*Primary Examiner*—C. D. Crowder
*Assistant Examiner*—Larry D. Worrell, Jr.
*Attorney, Agent, or Firm*—Jacobson, Price, Holman & Stern, PLLC.

[57] ABSTRACT

An adjustment strap for a jacket hood which includes a plurality of buttonholes spaced apart at a distance equal to a separation distance between two buttons located on an interior surface of the hood. One end of the adjustment strap is permanently anchored to the jacket or hood with the other end being slidable within a sleeve extending about the periphery of the hood opening. The adjustment strap is slidable between three positions to provide varying degrees of reduction of the size of the hood opening. At each of the three positions, at least one button is secured to the adjustment strap to maintain the position of the adjustment strap and thus the size of the opening of the hood, at a fixed position. Intentional manipulative effort must be performed to change the position of the adjustment strap so as to alter the size of the opening of the jacket hood.

16 Claims, 3 Drawing Sheets

ADJUSTMENT STRAP FOR JACKET HOOD

FIELD OF THE INVENTION

This invention relates to an adjustment strap which can reduce the opening of a jacket hood so as to protect the face of the wearer.

BACKGROUND OF THE INVENTION

There are a wide assortment of jacket hoods available in the marketplace, primarily in children's jackets. Most of these hoods have some sort of mechanism for adjusting the size of the opening of the hood. Oftentimes the size of the opening is reduced to increase protection of the face of the wearer in inclement weather.

The most common of these types of arrangements is a draw string which is tied in a bow below the chin of a child. However, oftentimes, the bow becomes untied either unintentionally or through the efforts of the child to release a restrictive encumbrance. The release of the drawstring may be without the knowledge of a supervising adult, thus increasing the exposure of a child to adverse weather conditions.

Accordingly, there is a need to ensure that a child is protected against inclement weather conditions which provide assurances that a reduced size hood opening will remain in a fixed position until a supervising adult releases the adjustment mechanism.

SUMMARY OF THE INVENTION

It is therefore an object of the present invention to provide an adjustment strap for a jacket hood which includes a plurality of buttonholes spaced apart at a distance equal to a separation distance between two buttons located on an interior surface of the hood. One end of the adjustment strap is permanently anchored to the jacket or hood with the other end being slidable within a sleeve extending about the periphery of the hood opening.

The adjustment strap is slidable between three positions to provide varying degrees of reduction of the size of the hood opening. At each of the three positions, at least one button is secured to the adjustment strap to maintain the position of the adjustment strap and thus the size of the opening of the hood, at a fixed position. Intentional manipulative effort must be performed to change the position of the adjustment strap so as to alter the size of the opening of the jacket hood.

It is therefore an object of the present invention to provide an adjustment strap for a jacket hood having a plurality of fixed positions which vary the size of the opening of the hood.

It is yet another object of the present invention to provide an adjustment strap for a jacket hood having a plurality of fixed positions which vary the size of the opening of the hood with the adjustment strap being secured in place by the cooperation of at least one button in a fixed position and at least one buttonhole on the adjustment strap.

It is still yet another object of the present invention to provide an adjustment strap for a jacket hood having a plurality of fixed positions which vary the size of the opening of the hood with the adjustment strap being secured in place by the cooperation of at least one button in a fixed position and at least one buttonhole on the adjustment strap with one end of the adjustment strap being anchored to the hood and the other end of the adjustment strap being slidable in a sleeve surrounding the opening of the jacket hood.

It is still yet another object of the present invention to provide an adjustment strap for a jacket hood having a plurality of fixed positions which vary the size of the opening of the hood with the adjustment strap being secured in place by the cooperation of at least one button in a fixed position and at least one buttonhole on the adjustment strap with one end of the adjustment strap being anchored to the hood and the other end of the adjustment strap being slidable in a sleeve surrounding the opening of the jacket hood with two buttons being secured to the jacket hood and the adjustment strap including three buttonholes.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
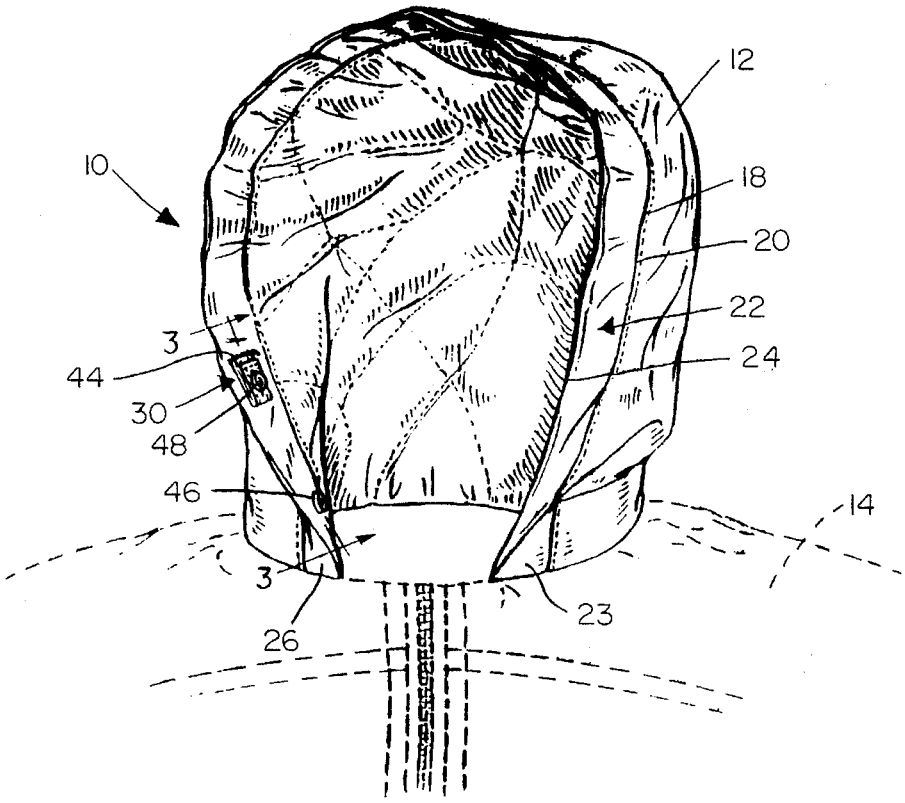
FIG. 1 is a front perspective view of a jacket hood having an adjustment strap embodying the principles of the subject invention.
Figure 2:
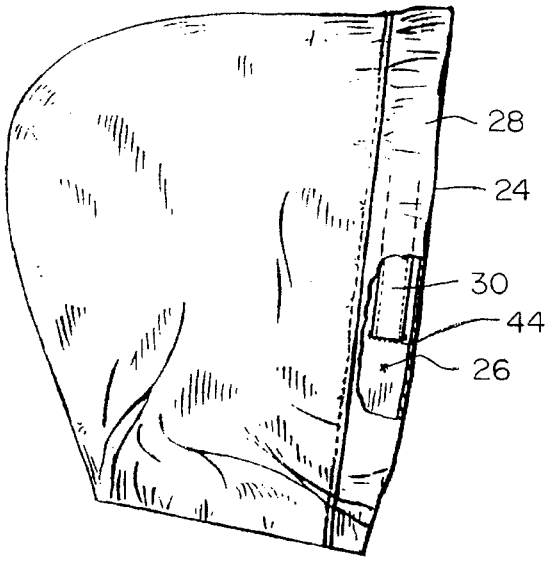
FIG. 2 is a side view illustrating the emergence of the adjustment strap through a slot in the sleeve in which the adjustment strap is slidably mounted.
Figure 3:
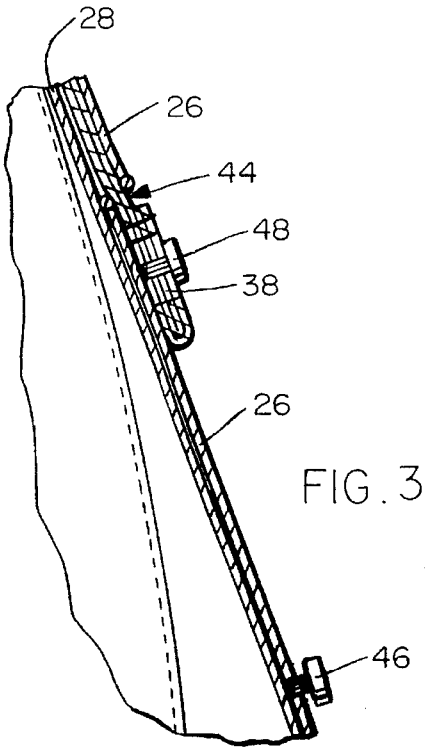
FIG. 3 is a sectional view taken along line 3—3 of FIG. 1.
Figure 4:
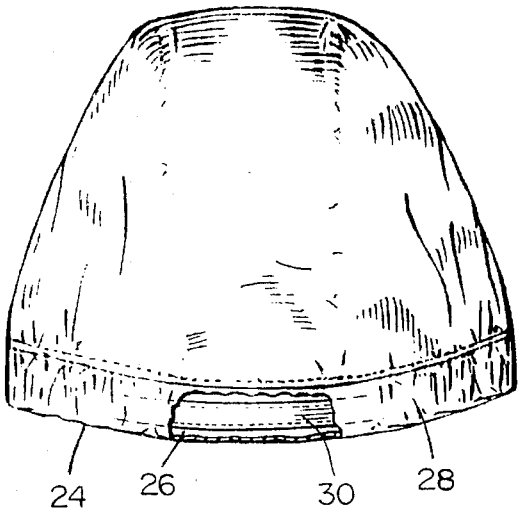
FIG. 4 is a partial sectional view of the adjustment strap located in a sleeve surrounding the front of the hood.
Figure 5:
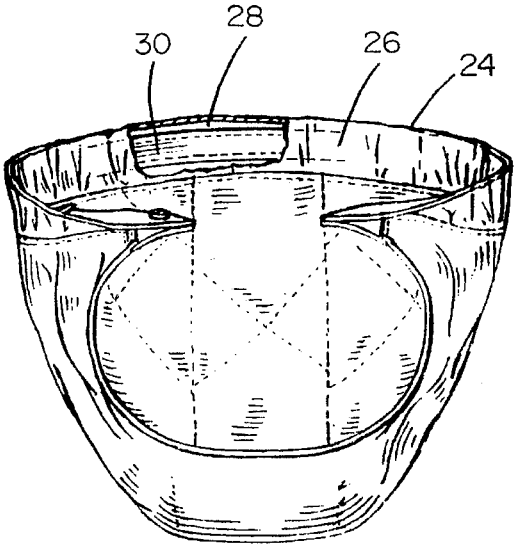
FIG. 5 is a partial sectional bottom view of the adjustment strap slidably mounted in a sleeve surrounding the hood opening.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 5, in particular, an adjustment strap for a jacket hood embodying the teachings of the subject invention is generally designated as 10. With reference to its orientation in FIG. 1, the adjustment strap forms part of a jacket hood 12 which is part of a jacket 14 shown in dotted lines.

At a forward or leading edge 18 of the hood 12, secured by stitching 20, is a sleeve 22 formed of a piece of material folded longitudinally upon itself along edge 24. The sleeve 22 includes opposite ends 23 and 26 which are secured to the jacket 14.

As shown in FIGS. 2 through 6, the sleeve 22 is formed of a single piece of material folded longitudinally over onto itself to form an interior layer of material 26 and an exterior layer of material 28 folded along edge 24. Slidably mounted within the sleeve 22 is a strap 30.

As seen from the various cutaway views in FIGS. 2 and 4 through 6, the strap 30 is an elongated piece of material extending through the sleeve and includes two ends 32 and 34. End 32 is fixed by stitching 36 to end 23 of sleeve 22 within the sleeve as shown by the cutaway view in FIG. 6.

Figure 6:
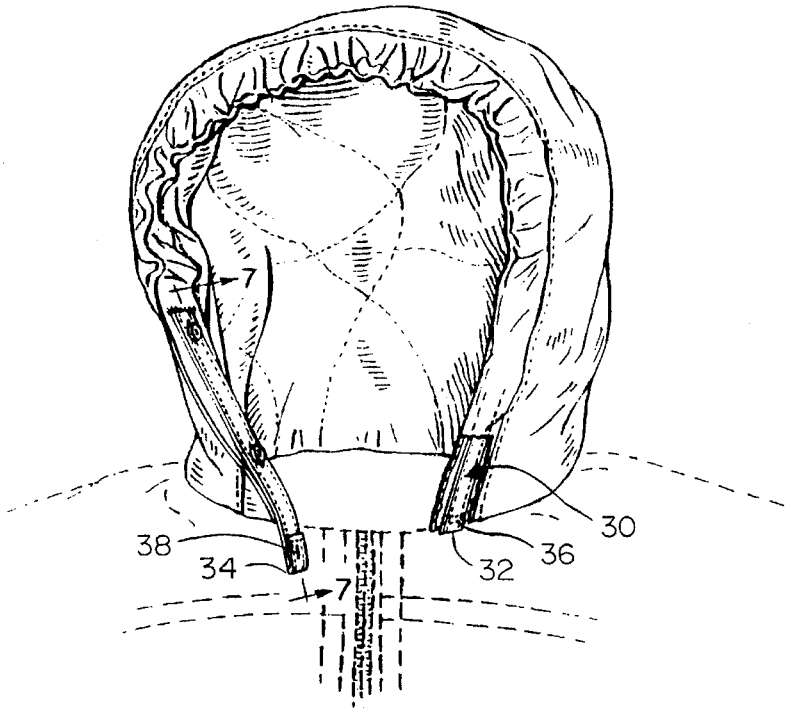
FIG. 6 is a front perspective view of the adjustment strap for a jacket hood according to the principles of the present invention with the adjustment strap being fixed in a different position from that shown in FIG. 1 for reducing the size of the opening of the hood.
Figure 7:
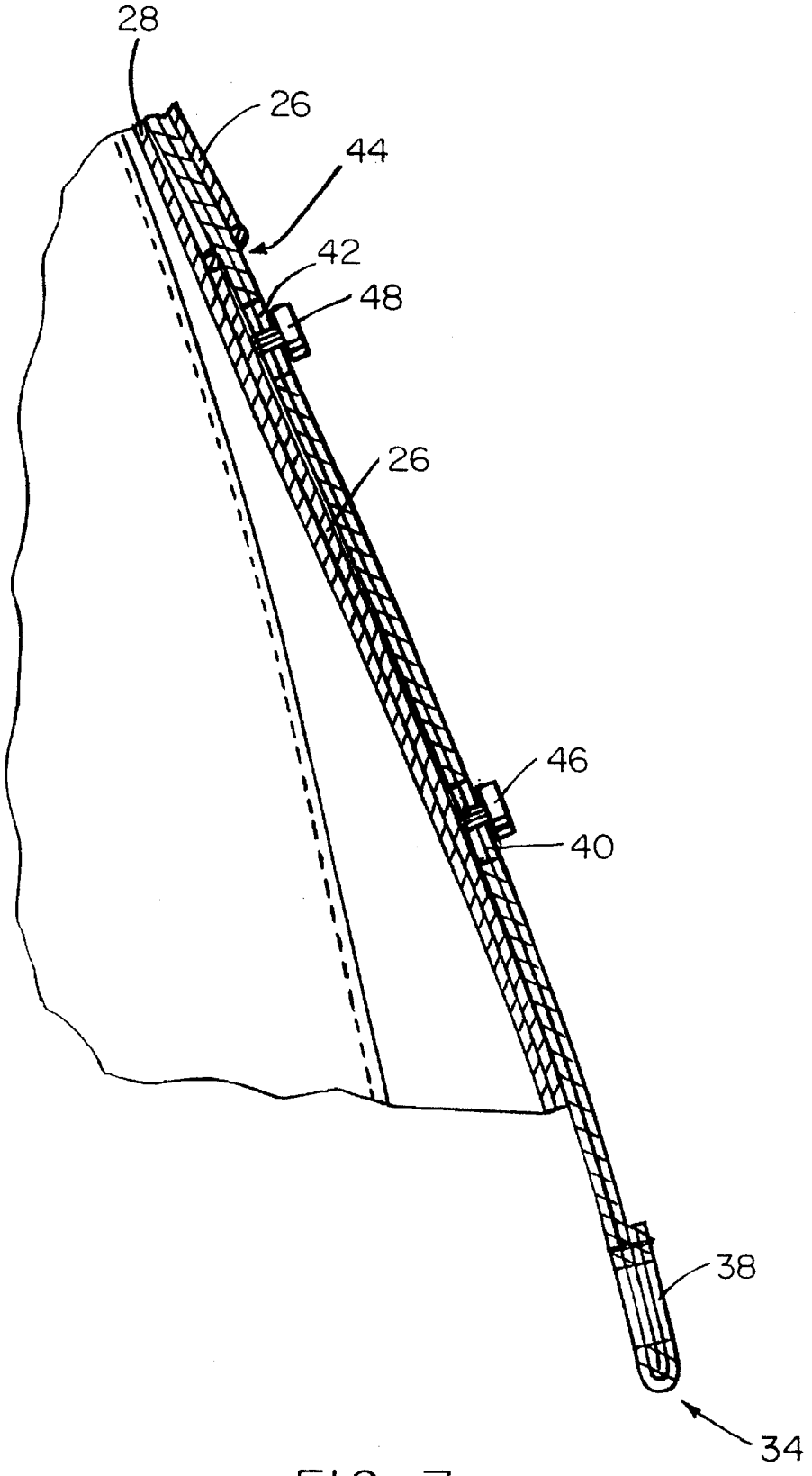
FIG. 7 is a sectional view taken along line 7—7 of FIG. 6.

As also seen in FIG. 6, the opposite end 34 of the strap 30 includes a buttonholes 38. Spaced from end 34 of strap 30, as shown in FIG. 7, are two additional buttonholes 40 and 42. The distance between buttonholes 38 and 40 is equal to the distance between buttonholes 40 and 42.

As seen in FIGS. 1, 3, 6 and 7, end 34 of strap 30 extends from between layers 26 and 28 of sleeve 22 through slot 44. Slot 44 is reinforced with stitching. End 34 is doubled over onto itself with buttonhole 38 passing therethrough to help prevent accidental passage of end 34 through slot 44 and into sleeve 22.

On interior layer 26 of sleeve 22 are positioned two buttons 46, 48. The spacing between buttons 46 and 48 is equal to the spacing between buttonholes 38 and 40 and the spacing between buttonholes 40 and 42.

In use, strap 30 is secured in position with buttonhole 38 being passed around upper button 48 as shown in FIG. 1. In this position, the hood 12 is in a fully open position. To reduce the size of the opening of the hood 12, the strap 30 is disengaged from button 48 by passage of the button 48 through buttonhole 38. The strap is then pulled until buttonhole 38 is securable on button 46. At this point, buttonhole 40 can be secured around button 48. This would produce a reduced size opening to the hood with the position of the slightly closed hood ensured by the buttons 46, 48 being secured in buttonholes 38, 40, respectively.

If a further closure of the size of the opening to hood 12 is required, the buttons 46, 48 are removed from buttonholes 38, 40, respectively, and the strap is pulled further out of the sleeve 22 until the buttons 46, 48 can be passed through buttonholes 40, 42, respectively, as shown in FIGS. 6 and 7. Due to the anchoring of end 32 of the strap 30 to the hood, the moving of the end 34 of strap 30 causes the sleeve 22 to be gathered or bunched up so as to reduce the size of the opening to the hood 12. The placement of the buttons 46, 48 in buttonholes 40, 42 fixes the reduced opening size of the hood so that it cannot be easily opened by a child.

If the size of the opening to the hood 12 is desired to be increased, the buttons 46, 48 are removed from the buttonholes 40, 42 and the opening to the hood is manually increased in size by the sliding of the end 34 of the strap 30 in a direction towards the interior of the sleeve 22 through the slot 44. The button 48 can then be passed through the buttonhole 38 to secure the adjustment strap for the hood in its fully open position.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A jacket hood comprising:

a head covering portion having an opening for exposing the face of a wearer, a sleeve located along an edge of said head covering portion, and an adjustment strap having two ends, said adjustment strap being slidably mounted in said sleeve and extending, at one of said two ends, from said sleeve, said one end being securable to said head covering portion in different positions to change a size of said opening so as to draw said head covering portion around the face of the wearer, the other of said two ends of said adjustment strap being fixed within said sleeve.

2. A jacket hood claimed in claim 1, wherein a plurality of securing devices are mounted on said head covering portion and said strap cooperates with said securing devices to change the size of said opening.

3. A jacket hood as claimed in claim 2, wherein said strap includes a cooperating securing device for engaging one of said securing devices on said head covering portion to change the size of said opening.

4. A jacket hood as claimed in claim 3, wherein said strap includes at least two cooperating securing devices for cooperating with at least one of said securing devices on said head covering portion to change the size of said opening.

5. A jacket hood as claimed in claim 4, wherein said strap includes three cooperating securing devices for cooperating with at least one of said securing devices on said head covering portion to change the size of said opening.

6. A jacket hood as claimed in claim 3, wherein said securing devices on said head covering portion are buttons.

7. A jacket hood as claimed in claim 6, wherein said cooperating securing devices of said strap are buttonholes.

8. A jacket hood as claimed in claim 1, wherein said strap extends from said sleeve through a slot.

9. A jacket comprising:

a body portion for surrounding the body of a wearer, a hood portion mounted on said body portion for covering the head of the wearer and having an opening for exposing the face of the wearer, a sleeve mounted on an edge of said hood portion, an adjustment strap located in said sleeve, said adjustment strap having two ends, and one of said two ends of said adjustment strap being securable to said hood portion in different positions to change a size of said opening so as to draw said hood portion around the face of the wearer, the other of said two ends of said adjustment strap being fixed within said sleeve.

10. A jacket hood claimed in claim 9, wherein a plurality of securing devices are mounted on said hood portion and said strap cooperates with said securing devices to change the size of said opening.

11. A jacket hood as claimed in claim 10, wherein said strap includes a cooperating securing device for engaging one of said securing devices on said hood portion to change the size of said opening.

12. A jacket hood as claimed in claim 11, wherein said strap includes at least two cooperating securing devices for cooperating with at least one of said securing devices on said hood portion to change the size of said opening.

13. A jacket hood as claimed in claim 12, wherein said strap includes three cooperating securing devices for cooperating with at least one of said securing devices on said hood portion to change the size of said opening.

14. A jacket hood as claimed in claim 11, wherein said securing devices on said hood portion are buttons.

15. A jacket hood as claimed in claim 14, wherein said cooperating securing devices of said strap are buttonholes.

16. A jacket hood as claimed in claim 9, wherein said strap extends from said sleeve through a slot.

* * * * *